US005921315A

United States Patent [19]

Dinh

[11] Patent Number: 5,921,315

[45] **Date of Patent: *Jul. 13, 1999**

[54] THREE-DIMENSIONAL HEAT PIPE

[75] Inventor: Khanh Dinh, Alachua, Fla.

[73] Assignee: Heat Pipe Technology, Inc., Alachua, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 08/487,151

[22] Filed: Jun. 7, 1995

Related U.S. Application Data

[51] Int. Cl.[6] ..... F28D 15/02

[52] U.S. Cl. ..... 165/104.21; 165/104.14

[58] Field of Search ..... 165/104.14, 104.21, 165/104.22, 104.28, 104.29

[56] References Cited

U.S. PATENT DOCUMENTS

| | | | |
|---|---|---|---|
| 3,143,592 | 8/1964 | August | 174/16.3 |
| 3,877,518 | 4/1975 | Dreksler . | |
| 4,091,547 | 5/1978 | Leigh . | |
| 4,222,436 | 9/1980 | Pravda | 165/104.21 |
| 4,259,268 | 3/1981 | DiRoss | 261/151 |
| 4,333,517 | 6/1982 | Parro | 165/104.21 X |
| 4,452,051 | 6/1984 | Berger et al. | 62/467 |
| 4,607,498 | 8/1986 | Dinh . | |
| 4,724,901 | 2/1988 | Munekawa | 165/104.21 |
| 4,827,733 | 5/1989 | Dinh . | |
| 4,921,041 | 5/1990 | Akachi | 165/104.29 |
| 5,033,539 | 7/1991 | Kohtaka | 165/104.14 |
| 5,219,020 | 6/1993 | Akachi | 165/104.14 X |
| 5,333,470 | 8/1994 | Dinh . | |
| 5,404,938 | 4/1995 | Dinh . | |

FOREIGN PATENT DOCUMENTS

| | | | |
|---|---|---|---|
| 0 046 716 | 3/1982 | European Pat. Off. . | |
| 2 330 965 | 6/1977 | France . | |
| 2 407 445 | 5/1979 | France . | |
| 2 479 435 | 10/1981 | France . | |
| 61-11591 | 1/1986 | Japan . | |
| 174896 | 7/1989 | Japan | 165/104.14 |
| 85346 | 1/1936 | Switzerland . | |
| 2 006 950 | 5/1979 | United Kingdom . | |

OTHER PUBLICATIONS

Patent Abstract of Japan, vol. 7, No. 74 (M–203) (1219) Mar. 26, 1983. & JP–A–58 002 593 (Hitachi Seisakusho KK) Jan. 8, 1983 (abstract).

*Primary Examiner*—Leonard R. Leo
*Attorney, Agent, or Firm*—Nilles & Nilles

[57] ABSTRACT

A heat pipe heat exchanger is provided in the form of a serpentine heat pipe that does not have the ends of the individual tubes manifolded to one another via a straight pipe or via any other common connector. Instead, it has been discovered that heat pipes connected via U-bends to form a continuous coil function adequately. The serpentine heat pipe may include integral condenser and evaporator portions separated by a divider to form a one-slab heat exchanger, or separate evaporator and condenser coils connected to one another by vapor and return lines to form a two-section heat pipe. The heat pipe heat exchanger may be formed in a continuous closed-loop pipe so that the heat exchanger can operate with or without the aid of gravitational effects. A method of producing a serpentine heat pipe includes providing a plurality of U-shaped tubes which are interconnected to form a single serpentine heat pipe, one of the tubes having an open end, and inserting sufficient refrigerant in the one tube to allow each of the tubes to function as a separate heat pipe. The serpentine heat pipe heat exchanger may be used to increase the dehumidification capacity of an air conditioner.

12 Claims, 11 Drawing Sheets

THREE-DIMENSIONAL HEAT PIPE

BACKGROUND OF THE INVENTION

The present invention relates to passive heat transfer devices and more particularly relates to heat pipes utilizing the high latent heat of evaporation and condensation, together with the phenomenon of capillary pumping of a wick, to transfer very high heat fluxes without the addition of external energy.

So-called heat pipes are well known, and typically comprise a condenser and an evaporator connected to one another as a closed system. Referring to FIG. 1, the typical heat pipe 6 comprises an enclosed tube 8 having one end forming an evaporator portion 10 and having another, somewhat-cooler and lower-pressure end forming a condenser portion 12. A wick 14 extends through the heat pipe from the evaporator portion 10 to the condenser portion 12. The surrounding environment is cooled by the evaporator portion and reheated by the condenser portion with the help of fins 15.

In use, liquid refrigerant 11 present in the evaporator portion 10 is heated by the environment, vaporized, and rises into the condenser portion 12. In the condenser portion 12, the refrigerant is cooled by the environment, is condensed with the release of latent heat, and is then pumped back to the evaporator portion 10 by the action of the capillary structure of the material forming the wick 14. The cycle then repeats itself, resulting in a continuous cycle in which heat is absorbed from the environment by the evaporator and released by the condenser.

As illustrated in FIG. 2, it is also known to increase the capacity of heat pipes by incorporating several individual heat pipes 20 in a single assembly 21. Each individual heat pipe is constructed and operable as the heat pipe illustrated in FIG. 1. While such an assembly has a significantly higher capacity than a single heat pipe, it is difficult and expensive to fabricate since each pipe must be individually charged with the proper amount of refrigerant.

Referring now to FIGS. 3A and 6A, it has been proposed to reduce the fabrication and installation costs of heat pipes by utilizing U-shaped heat pipes connected to form serpentine heat pipes. Fabrication costs are decreased through the use of the U-shaped tubes. However, it was thought that the individual tubes of such heat pipes could not be charged with refrigerant and that the serpentine coils would inhibit fluid movement through the heat pipes, thus decreasing their efficiency. One way that such serpentine heat exchangers are rendered useful as heat pipes is to vertically orient a heat exchanger such that the tops of individual coils act as condensers and the bottoms act as evaporators. The individual coils are manifolded together to provide what were thought to be the interconnections required to enable charging of the individual heat pipes. Thus, referring to FIG. 3A, the ends of the individual U-tubes 30A of a heat pipe are manifolded in such a way that the liquid refrigerant can move freely from tube to tube, thus assuring that the liquid level 34A is the same in all tubes. More specifically, the bottoms 35A of the U tubes 30A are pierced and small copper tubes 36A are soldered to the perforations to interconnect the U tubes at their lower ends. The open ends of the adjacent U tubes are manifolded to one another by a straight pipe 37A. The resulting connection allows unrestricted communication between the ends of adjacent tubes and assures that the liquid level is the same in all tubes. Microgrooves 33 are formed in each tube 30A, and the individual tubes are imbedded in aluminum fins 32 to form a heat pipe heat exchanger.

In another configuration utilizing serpentine heat exchangers, two horizontal heat exchangers may be connected to one another such that the lower of the two horizontal serpentine heat exchangers acts as an evaporator and the higher one acts as a condenser. Referring to FIG. 6A, it was thought necessary to manifold the U tubes 60A of the lower section by a first copper tube 63A and to manifold the U tubes 61A of the upper section in the same manner by a second copper tube 64A. The upper ends of these manifolded tubes are connected by a first copper connection tube 62A which serves as a vapor line, while the lower ends of these tubes are connected by a second copper connection tube 65A serving as a return line.

Each of the devices illustrated in FIGS. 3A and 6A works well. However, both devices are expensive to fabricate and to install, thus rendering them unsuitable for many applications.

Moreover, each of these embodiments works on the basic principle of gravity. That being when the refrigerant is condensed in the condenser it returns to the evaporator as a liquid by gravitational force. The gravitational effect occurs in these systems because of the orientation of the condenser related to the evaporator. In order for these arrangements to operate effectively, the condenser must be higher, relative to a ground position, than the evaporator. Thus, if either of these arrangements is installed in a different orientation than as described the devices will not operate properly.

It is also known to use heat pipes to increase the dehumidification capacity or efficiency of an air conditioning system. One such system is described in U.S. Pat. No. 4,607,498, which issued to Khanh Dinh on Aug. 26, 1986. Referring to FIG. 13, this type of air conditioning system 110 includes a primary evaporator 124 and a heat pipe heat exchanger 126 which is provided to increase the dehumidification capacity of the system during cool and humid hours. This heat pipe consists of a pair of manifolded heat exchangers of the type illustrated in FIG. 6A. A first heat exchanger 128 serves as an evaporator and is located between an inlet of the air conditioner and the primary coil 124. A second manifolded heat exchanger 130 is located between the primary evaporator 124 and the outlet of the housing and serves as a condenser of the heat pipe. The heat sections 128 and 130 are interconnected by a vapor line 134 and a return line 140.

The heat pipe heat exchanger 126 operates as follows:

Warm air enters the housing from the inlet and is cooled slightly as it passes over evaporator 128, thereby vaporizing the liquified refrigerant present in the evaporator. The air then passes over the primary evaporator 124, where it is cooled further. Meanwhile, the vaporized refrigerant rises out of the header of the evaporator 128, through conduit 134, and into the header of condenser 130. The refrigerant in the condenser 130 is cooled by air exiting the primary evaporator 124 so that it is liquefied while simultaneously reheating the air. The liquified refrigerant then flows downwardly into the inlet of evaporator 128 via conduit 140, and the process is repeated.

While the heat pipes described above significantly improve the efficiency of air conditioners, the manifolded heat pipes require additional machining of the serpentine coils and require that headers be connected to the ends of the coils. Accordingly, they are relatively difficult and expensive to fabricate. Thus, the cost of such heat pipes may render impractical their use in many applications, including many conventional air conditioning systems.

OBJECTS AND SUMMARY OF THE INVENTION

An object of the invention is to provide a serpentine heat pipe which is inexpensive to fabricate and which can be easily charged with refrigerant.

In accordance with a first aspect of the invention, this object is achieved by providing a serpentine heat pipe having a plurality of U-shaped tubes having adjacent open ends and a plurality of U-shaped connectors interconnecting the adjacent open ends to form a single serpentine heat pipe. The tubes are partially filled with a refrigerant.

Further in accordance with this aspect of the invention, fins interconnect the U-shaped tubes, thereby forming a serpentine heat pipe heat exchanger. The serpentine heat exchanger may include integral condenser and evaporator portions separated by a divider to form a one-slab heat exchanger, or separate evaporator and condenser coils connected to one another by vapor and return lines to form a two-section heat pipe.

Another object of the invention is to provide a method of easily and inexpensively producing a serpentine heat pipe.

In accordance with this aspect of the invention, the method includes the steps of providing a plurality of U-shaped tubes which are interconnected to form a single serpentine heat pipe, one of the tubes having an open end, and inserting sufficient refrigerant in the one tube to allow each of the tubes to function as a separate heat pipe.

Further in accordance with this aspect of the invention, the providing step may comprise providing a plurality of adjacent U-shaped tubes having adjacent open ends, and manifolding together the adjacent open ends via U-shaped connectors.

Still another object of the invention is to provide a method of economically increasing the dehumidification capacity of the primary evaporator of an air conditioner.

In accordance with this aspect of the invention, the method comprises pre-cooling and dehumidifying air via an evaporator portion of a serpentine heat exchanger comprising at least one serpentine heat pipe, then cooling the air via a primary evaporator, and then reheating the air via a condenser portion of the heat pipe heat exchanger.

A further objective of the invention is to provide a device that can operate as a heat pipe without the use of gravity. In accordance with this aspect of the invention, this object is achieved by providing a continuous closed-loop pipe that has a first portion that serves as an evaporator and a second portion that serves as a condenser. The continuous closed-loop pipe contains a refrigerant so that the device forms a heat pipe.

Further in accordance with this aspect of the invention, the first and second portions of the continuous close-loop pipe may either be parts of a serpentine section of the continuous close-loop pipe or separate serpentine sections themselves.

Another objective of the invention is to provide a method of providing a heat pipe that can be used in an orientation irrespective of gravity.

In accordance with this aspect of the invention, the method comprises providing a continuous closed-loop pipe having a first portion and a second portion, then refrigerant is inserted into the continuous closed-loop pipe so that a first portion of the closed-loop pipe serves as an evaporator and a second portion of the closed-loop pipe serves as a condenser. Moreover, according to this aspect of the invention, the refrigerant moves about the continuous closed-loop pipe by a pumping action created by the temperature difference exposed to the pipe and the pressure differences within the pipe.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more clearly understood from the detailed description to follow, reference being had to the accompanying drawings in which like reference numerals represent like parts throughout, and in which.

DETAILED DESCRIPTION OF THE PREFERRED EMBODIMENTS

Pursuant to the invention, a heat pipe heat exchanger is provided in the form of a serpentine heat pipe that does not have the ends of the individual tubes manifolded to one another via a straight pipe or via any other common connector. Instead, it has been discovered that heat pipes connected via U-bends to form a continuous coil function adequately.

Figure 3B:
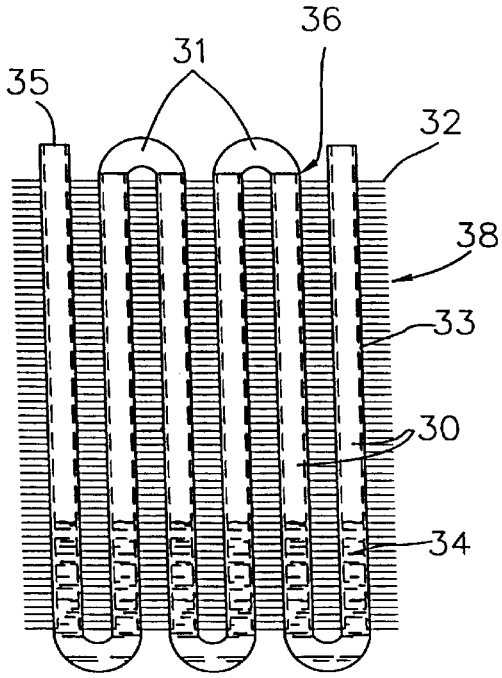
FIG. 3B is a sectional schematic elevation view of a serpentine heat pipe refrigerant constructed in accordance with a first embodiment of the invention.

Referring to FIG. 3B, a heat pipe heat exchanger 38 constructed in accordance with the present invention, includes a plurality of U-shaped tubes 30 which are manifolded to one another via U-bends 31 which interconnect the open ends of the adjacent tubes 30, thereby forming a serpentine heat pipe 36. The heat pipe is embedded in heat conducting fins 32, preferably formed from aluminum, thus forming the serpentine heat pipe heat exchanger 38. The individual tubes 30 do not contain a wick, but instead have microgrooves 33 formed on their internal walls for higher heat transfer.

Figure 6A:
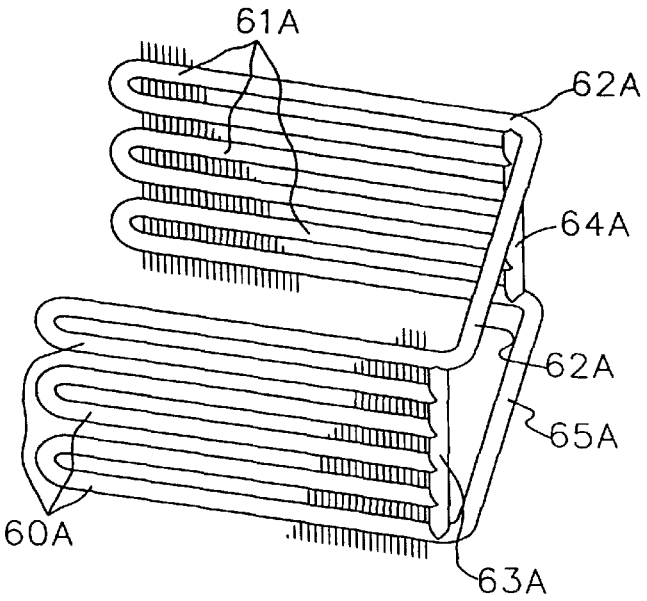
FIG. 6A PRIOR ART
FIG. 6A is a perspective view of a conventional two-section heat pipe heat exchanger.
Figure 3A:
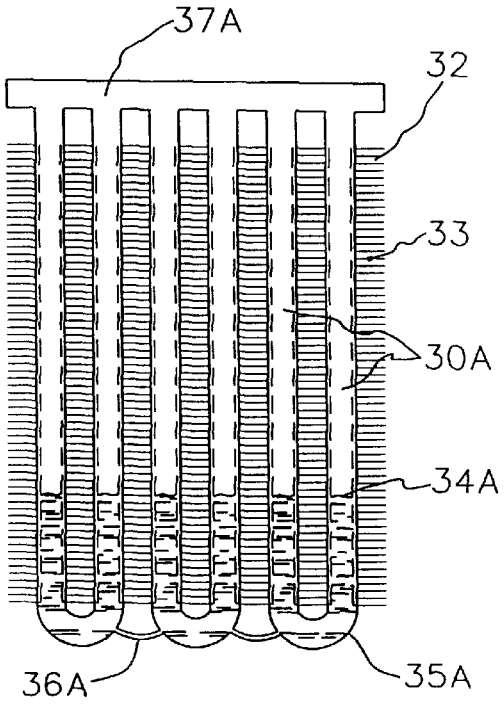
FIG. 3A PRIOR ART
FIG. 3A is a sectional schematic elevation view of a conventional serpentine heat pipe.

To prepare the heat pipe heat exchanger 38 of FIG. 3 for use, a predetermined amount of refrigerant 34 is inserted into the open end of an edge tube 35 of the serpentine heat pipe 36. Enough refrigerant should be inserted so that, in steady state operating conditions, sufficient refrigerant will be present in each tube 30 to allow each tube to function adequately as a separate heat pipe. Heretofore, it was thought that such fluid levels could be obtained in the individual tubes only by manifolding the individual tubes together as described above in connection with FIGS. 3A and 6A. However, it has been discovered that no such manifolding is necessary and that, if the fluid is inserted in the edge tube of a serpentine heat pipe of the type illustrated in FIG. 3B, the fluid will be evenly distributed in the tubes as illustrated in FIG. 3B after only a few minutes of normal operation of the device. Accordingly, it has been found that the connection tubes and straight pipe manifolds of previous serpentine heat pipes are not required.

Figure 4:
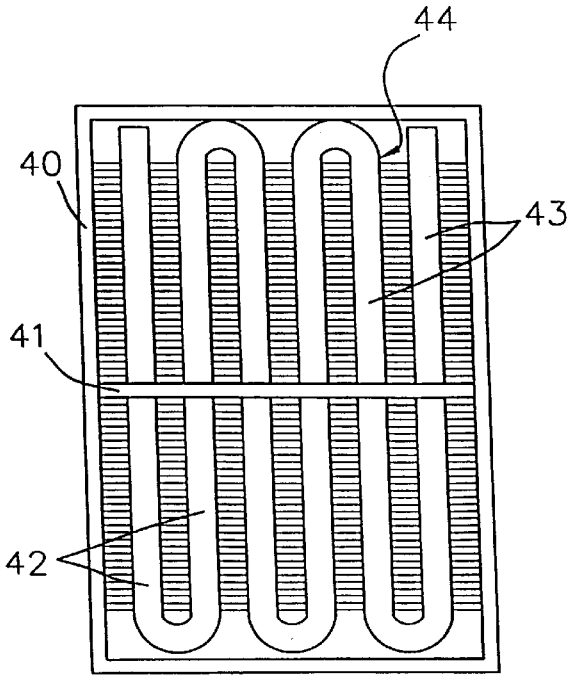
FIG. 4 is a schematic sectional side view of a one-slab serpentine heat pipe heat exchanger constructed in accordance with the invention.

Referring now to FIG. 4, the serpentine heat pipe discussed above can be used in a one-slab heat pipe heat exchanger 40 having a central divider 41 thermally separating the upper and lower portions forming evaporator and condenser portions of the individual tubes of a heat pipe 44. In use, warm air is conveyed through the lower section of the serpentine heat exchanger, thus vaporizing the fluid in the lower portions 42 of the individual tubes and cooling the air. The vaporized fluid rises into the upper section of the heat exchanger where it is condensed in the upper portions 43 of the tubes via relatively cool air flowing through that section of the heat pipe heat exchanger. The thus condensed liquid then flows back into the lower portions 42 of the tubes via the microgrooves formed in the tubes, and the process begins anew.

Figure 5:
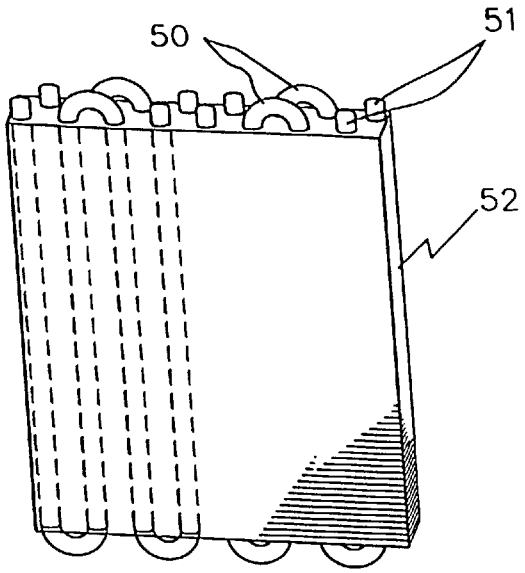
FIG. 5 is a perspective view of a one-slab heat pipe heat exchanger having several rows of serpentine heat pipes.

As illustrated in FIG. 5, several serpentine heat pipes 50 of the type illustrated in FIGS. 3 and 4 can be stacked in several rows 51 to form a one-slab heat pipe heat exchanger 52, thus increasing the cooling and heating capacities of the evaporator and condenser portions of the heat exchanger.

Figure 6B:
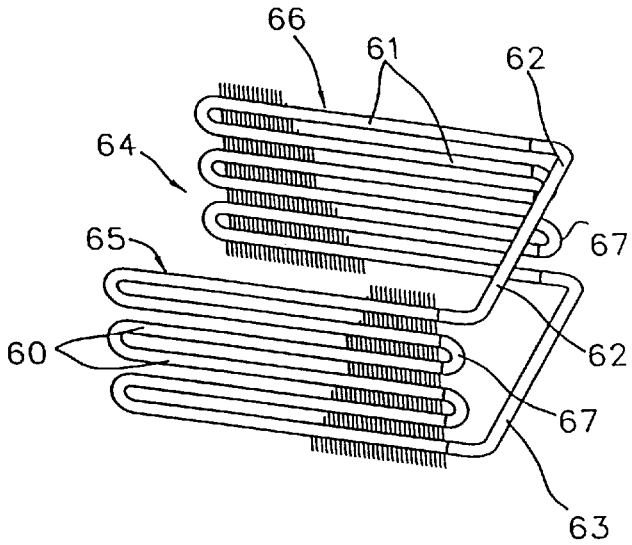
FIG. 6B is a perspective view of a two-section heat pipe heat exchanger constructed in accordance with another embodiment of the invention.
Figure 7:
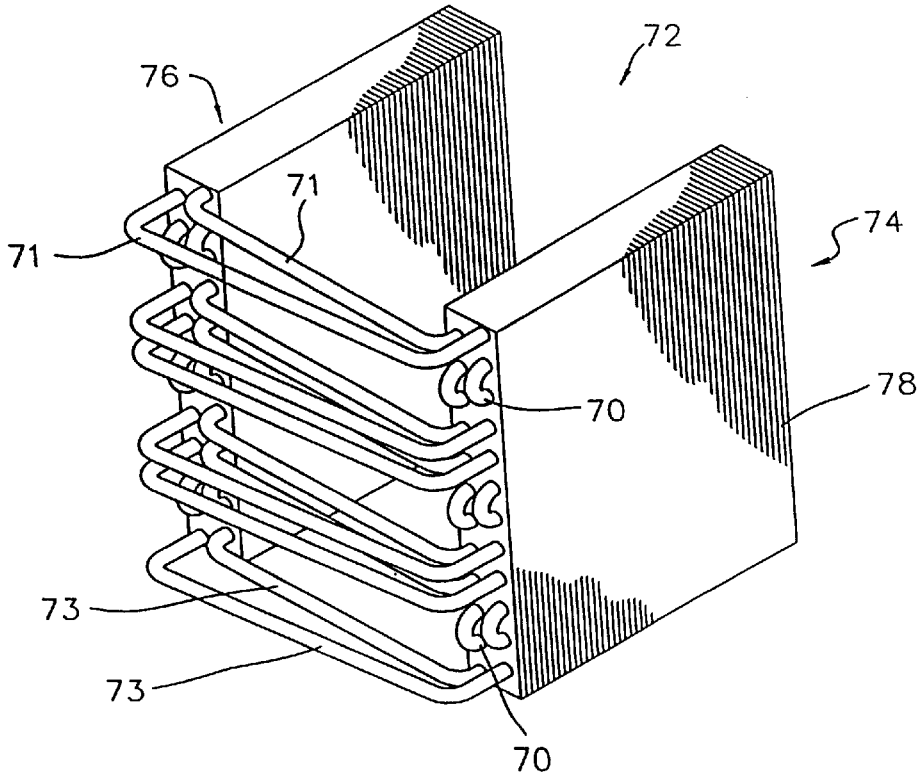
FIG. 7 is a perspective view of a two-section heat pipe heat exchanger constructed in accordance with the invention having multiple rows of stacked two-section heat pipes.

Turning now to FIG. 6B, a serpentine heat pipe 67 can also be designed as two separate sections. The heat pipe according to this embodiment of the invention includes serpentine coils 60, 61 forming a lower serpentine section 65 which functions as an evaporator, and a higher serpentine section 66 which functions as a condenser. As in the previous embodiment, each of the serpentine coils 60, 61 includes a plurality of U-tubes having the adjacent open ends manifolded together by U-bends 64 instead of one straight copper tube. Again, it has been discovered that this configuration works equally as well as the manifolded device illustrated in FIG. 6A, but is significantly less expensive and easier to fabricate. The two serpentine sections 65, 66 are connected to one another via a vapor line 62 and a return line 63, thereby forming the two-section heat pipe 64. If desired, several two-section heat pipes 70 can be stacked on top of one another and connected by vapor and return lines 71,73 as illustrated in FIG. 7 to form a single heat pipe heat exchanger 72 having an evaporator section 74 and a condenser section 76, each of which includes a plurality of serpentine coils. As in the embodiments of FIGS. 3–5, each section of the heat pipe heat exchanger is imbedded in aluminum fins 78 to promote heat transfer.

These inventive heat pipes and heat pipe heat exchangers can be used to increase the dehumidification capacity of conventional air conditioning systems. More particularly, the evaporator portion of a serpentine heat pipe heat exchanger can be positioned upstream of the primary evaporator of an air conditioner to precool and dehumidify the air flowing through the system, and the condenser portion can be positioned downstream of the primary evaporator to reheat the overcooled air.

Figure 8:
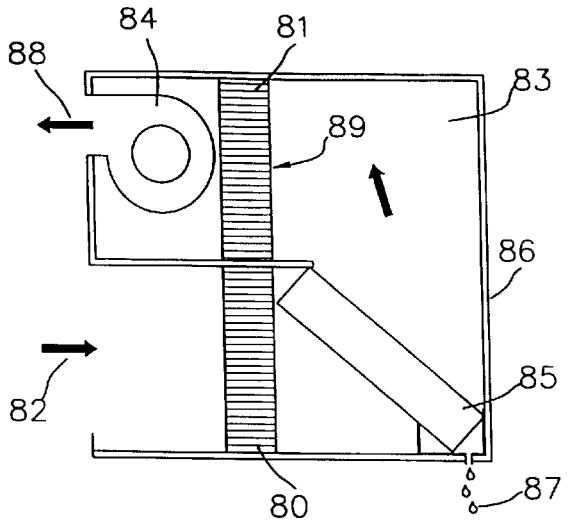
FIG. 8 illustrates a method of installing a serpentine heat pipe heat exchanger in an air conditioning system.

Referring to FIG. 8, a serpentine heat pipe heat exchanger 89 can be installed in a conventional air conditioning system by placing the evaporator portion 80 of a serpentine heat pipe of the heat exchanger 89 in the warm return air path 82 leading to the primary evaporator 85 of the air conditioner and by placing the condenser portion 81 downstream of the primary evaporator 85 in the cool air supply path 88. This positioning allows the refrigerant to vaporize in the evaporator portion 80 and to rise to the condenser portion 81. There, cool air being drawn off from the primary evaporator 85 via a blower 84 is reheated in condenser portion 81, where it condenses the refrigerant in condenser portion 81 before it is discharged from the air conditioner.

vaporizing in the evaporator portion 80 absorbs the heat from return air 82 and precools this air before the air reaches the primary evaporator 85. This precooling allows the primary evaporator 85 to work cooler and thus to condense more moisture, which is discharged from the evaporator as a condensate 87. The vaporized refrigerant in the heat pipe of the serpentine heat exchanger 89 rises to the condenser portion 81, condenses, and releases heat into the supply air 88.

This arrangement provides cool air with lower relative humidity. Demand for such cool, dry air is very high in humid climates and in certain industrial and commercial applications. Precooling and reheating the air in an air conditioner has numerous beneficial results and can save great amounts of energy. For example, by precooling the return air 82, the serpentine heat pipe heat exchanger 89 reduces the cooling load on the compressor of the air conditioner. In addition, by providing dry air, the system reduces humidity and provides better comfort at higher thermostat temperature settings. Finally, by providing free reheating energy, the system replaces the reheat systems currently used in humidity control systems, thus saving substantial energy which would otherwise be consumed by such reheat systems.

Figure 9:
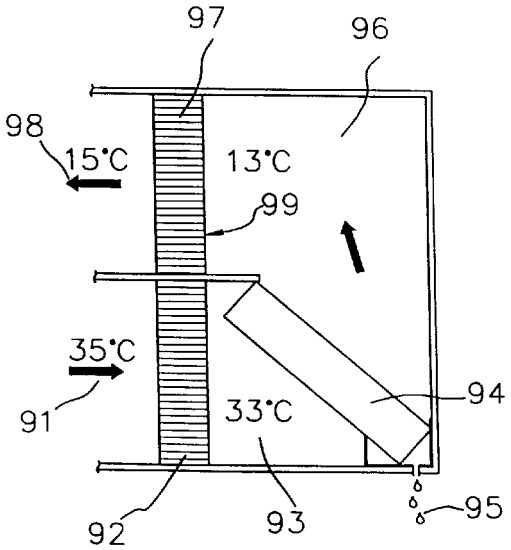
FIG. 9 illustrates the manner of operation of the heat pipe heat exchanger of FIG. 8 in conjunction with an air conditioning system.

The working principles of the serpentine heat pipe heat exchanger in an air conditioning system will now be disclosed with reference to FIG. 9. In the typical case, warm return air 91 at a temperature of, e.g., 35° C. enters the air conditioner and is conveyed through the evaporator portion 92 of a serpentine heat pipe of a serpentine heat pipe heat exchanger 99 and transfers heat to the refrigerant in the heat pipe, thus vaporizing the refrigerant. This heat transfer precools the air exiting the evaporator portion 92 to a somewhat lower temperature of, e.g., 33° C. This cooler air is then dehumidified and cooled in the primary evaporator 94 to a temperature of, e.g., 13° C. The moisture condensing in primary evaporator 94 drains out of the system as a condensate 95. The now overcooled air 96 is then conveyed through the condenser portion 97 of the heat pipe and is slightly reheated to a comfortable temperature of, e.g., 15° C. This heat transfer condenses the refrigerant in the condenser portion 97, and the condensed refrigerant drains back into evaporator portion 92. The thus reheated air 98 is then conveyed out of the air conditioner.

This method of using serpentine heat pipes to precool the return air and to reheat the supply air in an air conditioning system can be applied to both the one-slab design of a heat pipe heat exchanger illustrated in FIGS. 3–5 and to the two-section design illustrated in FIGS. 6 and 7. Moreover, there are several ways of positioning the serpentine heat exchangers in air conditioners. Some possible configurations of such serpentine heat exchangers are illustrated in FIGS. 8–12 with FIGS. 8, 9, and 10 illustrating a one-slab design and FIGS. 11 and 12 illustrating a two-section design.

Figure 10:
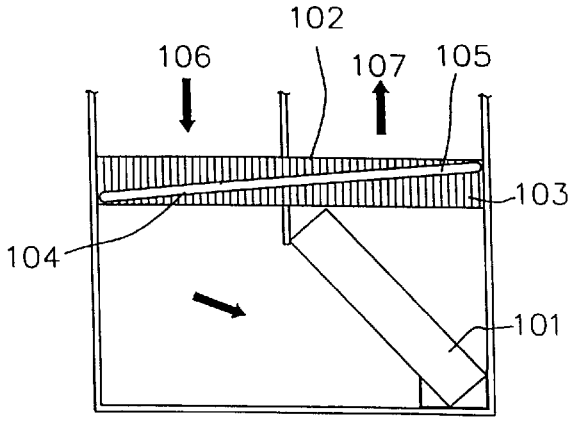
FIG. 10 illustrates another configuration of a heat pipe heat exchanger in an air conditioning system.

One-slab heat exchangers can be positioned in an air conditioning system either vertically as described above in connection with FIGS. 8 and 9, or horizontally, as illustrated in FIG. 10. In FIG. 10, the one-slab heat exchanger 102 is positioned horizontally, but the individual serpentine heat pipes within the slab are inclined with their lower or evaporator portions 104 in the warm return air path 106 and their higher or condenser portions 105 in the cold supply air path 107. Fins 103 promote heat transfer in the heat exchanger 102. The operation of this device is identical to that disclosed above with respect to FIGS. 8 and 9.

Figure 11:
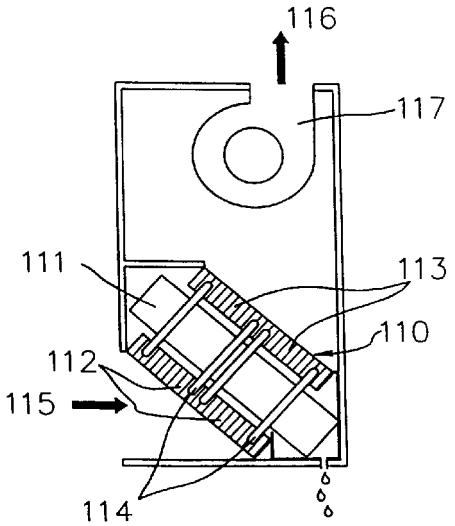
FIG. 11 illustrates still another configuration of a heat pipe heat exchanger in an air conditioning system.

Referring to FIG. 11, a two-section serpentine heat pipe heat exchanger 110 can also be positioned in an air conditioner in an inclined position. In this embodiment, return air 115 is drawn into the system via a blower 117. The lower or evaporator section 112 of each heat pipe of the heat exchanger 110 is placed in the path of the warm return air 115 leading to the air conditioner evaporator 111. The higher or condenser section 113 of each heat pipe of the heat exchanger 110 is positioned downstream of the evaporator 111 in the path 116 of cold supply air. Each of the sections 112, 113 may comprise several rows of stacked serpentine coils of the types illustrated in FIGS. 6 and 7. The lower and upper coils of each two-section heat pipe are connected by connection lines 114 composed of vapor and return lines connecting the upper and lower ends of the respective coils.

Figure 12:
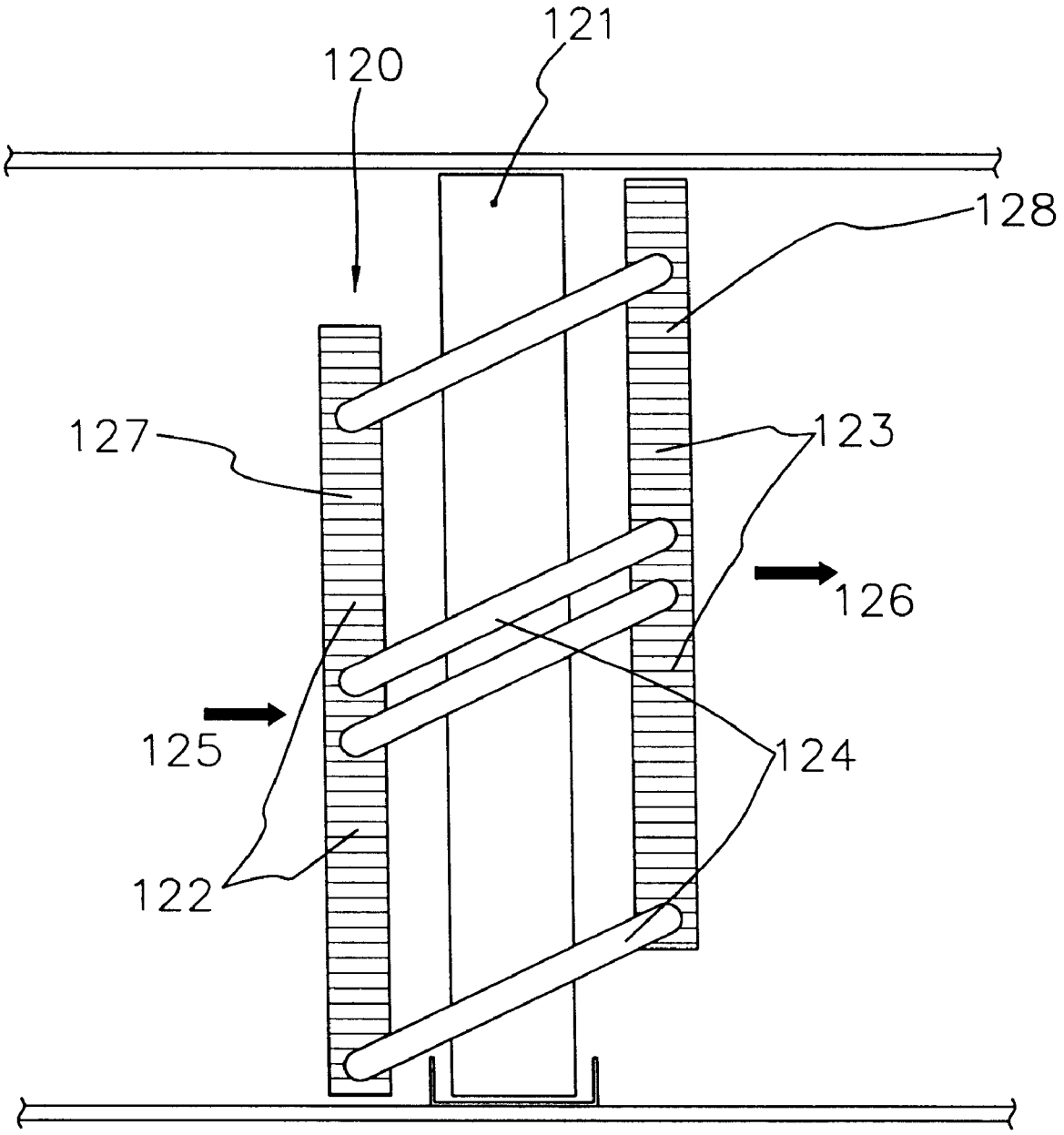
FIG. 12 illustrates yet another configuration of a heat pipe heat exchanger in an air conditioning system.
Figure 13:
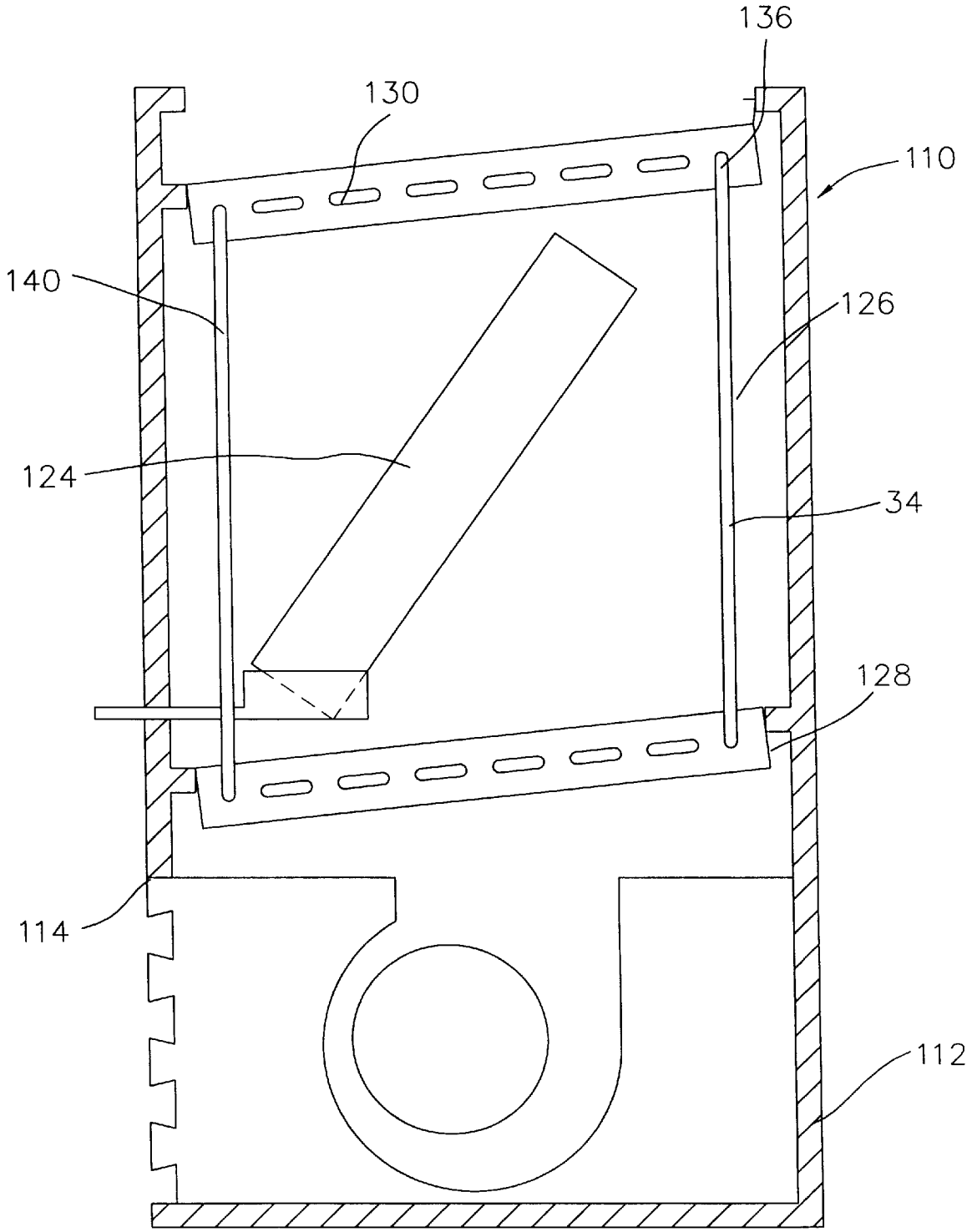
FIG. 13 PRIOR ART
FIG. 13 illustrates a conventional configuration of a heat pipe heat exchanger in an air conditioning system.

Referring to FIG. 12, an inventive two-section heat pipe heat exchanger refrigerant 120 of the type described above in connection with FIGS. 6 and 7 can also be used when an air conditioner evaporator 121 is in a vertical position. According to this embodiment of the invention, the evaporator section 127 of the heat exchanger 120 contains the low or evaporator sections 122 of the individual two-section serpentine heat pipes stacked one on top of the other upstream of the primary evaporator 121 in the path 125 of warm return air. A condenser section 128 of the two-section heat exchanger 120 contains the high or condenser sections 123 of the two-section serpentine heat pipes and is placed in the path 126 of cold supply air. The serpentine coils comprising the low and high sections of each of the heat pipes are connected by connection lines 124. As in the previous embodiments, refrigerant is pre-cooled by the evaporator section 127 and is reheated by the condenser section 128, thus enhancing the dehumidification capacity of the system.

Of course, the serpentine heat pipe heat exchanger of the present invention need not be positioned in an air conditioning system in any of the configurations illustrated above. It is only necessary to design the system such that the evaporator portion or section of one or more serpentine heat pipes functions to precool return air before it is cooled by the primary evaporator of the air conditioning system, and such that the condenser portion or section functions to reheat the supply air after it is cooled by the primary evaporator.

In addition to the serpentine heat pipe heat exchanger discussed above, the present invention also encompasses any heat pipe heat exchanger that includes a continuous closed-loop pipe as shown, for example, in FIG. 6B. The continuous closed-loop pipe includes a first portion and a second portion that operate, respectively, as the evaporator or the condenser of the heat pipe. The term continuous in the phrase continuous closed-loop pipe means that the pipe is of a single undivided path. The term closed-loop means that the pipe itself includes a path so that refrigerant can traverse the whole length of the pipe and return to its original starting point. Within this definition, the pipe may include a divider placed in the middle of the pipe. However, the pipe may not include branched off sections as shown in prior art FIG. 6A.

FIG. 6B, described above, shows a two-section heat pipe heat exchanger constructed in accordance with the invention that employs a plurality of U-shaped tubes. The two-section heat pipe 64 is also a continuous closed-loop pipe. Specifically, as shown in FIG. 6B, the heat pipe 64 is actually one long continuous closed-loop pipe. This closed loop-pipe has a first portion, the lower serpentine section 65, that operates as an evaporator, and a second portion, the higher serpentine section 66, that operates as a condenser. Because the heat pipe shown in FIG. 6B is actually one long continuous pipe, the refrigerant within the pipe is pushed through the pipe because of the pressure differences created in the different serpentine sections 65, 66 when the heat pipe is installed in an air flow. This advantageous feature allows the heat pipe to be installed in a horizontal arrangement, whereby it is not necessary to use a wick within the heat pipe.

As discussed above, FIG. 7 shows the two-section heat pipe 64 installed in a heat pipe heat exchanger 72. Because the heat two-section heat pipe 64 can operate without a difference in level, the single heat pipe heat exchanger 72 can be placed in a horizontal configuration to wrap around a primary cooling coil.

During operation of the two-section heat pipe 64, a pressure differential is created due to the air flow across the heat pipe heating different portions of the heat pipe by different amounts. This pressure forces the refrigerant through the pipe in a percolating manner. With this advantageous feature of the continuous closed-loop pipe of the two-section heat pipe 64, all of the serpentine coils 60 and 61 of the serpentine section 65 and 66 are wetted and have an operative effect in the system when installed in a horizontal configuration. When referring to a horizontal configuration, what is meant is that the plane passing through the serpentine sections 65 and 66 is perpendicular to the ground.

Thus, the invention as described above with regard to the U-shaped tubes that achieves one of the objectives of the invention described above, also serves as a first embodiment of the additional objective of the invention of providing a heat pipe that can operate without the use of a difference in level. Two additional continuous closed-loop heat pipe are described below.

Figure 14:
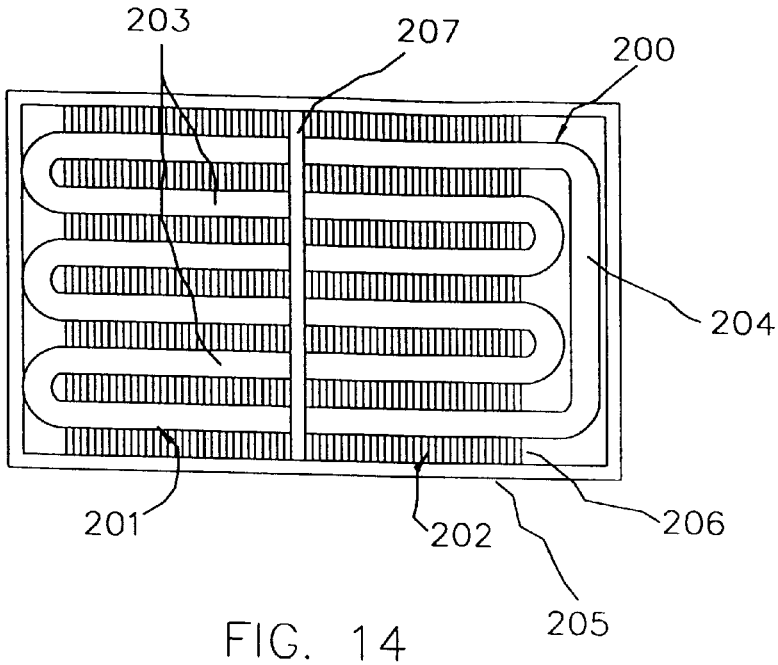
FIG. 14 illustrates a schematic sectional side view of a one-slab heat pipe heat exchanger constructed in accordance with a continuous closed-loop pipe of the invention.
Figure 17:
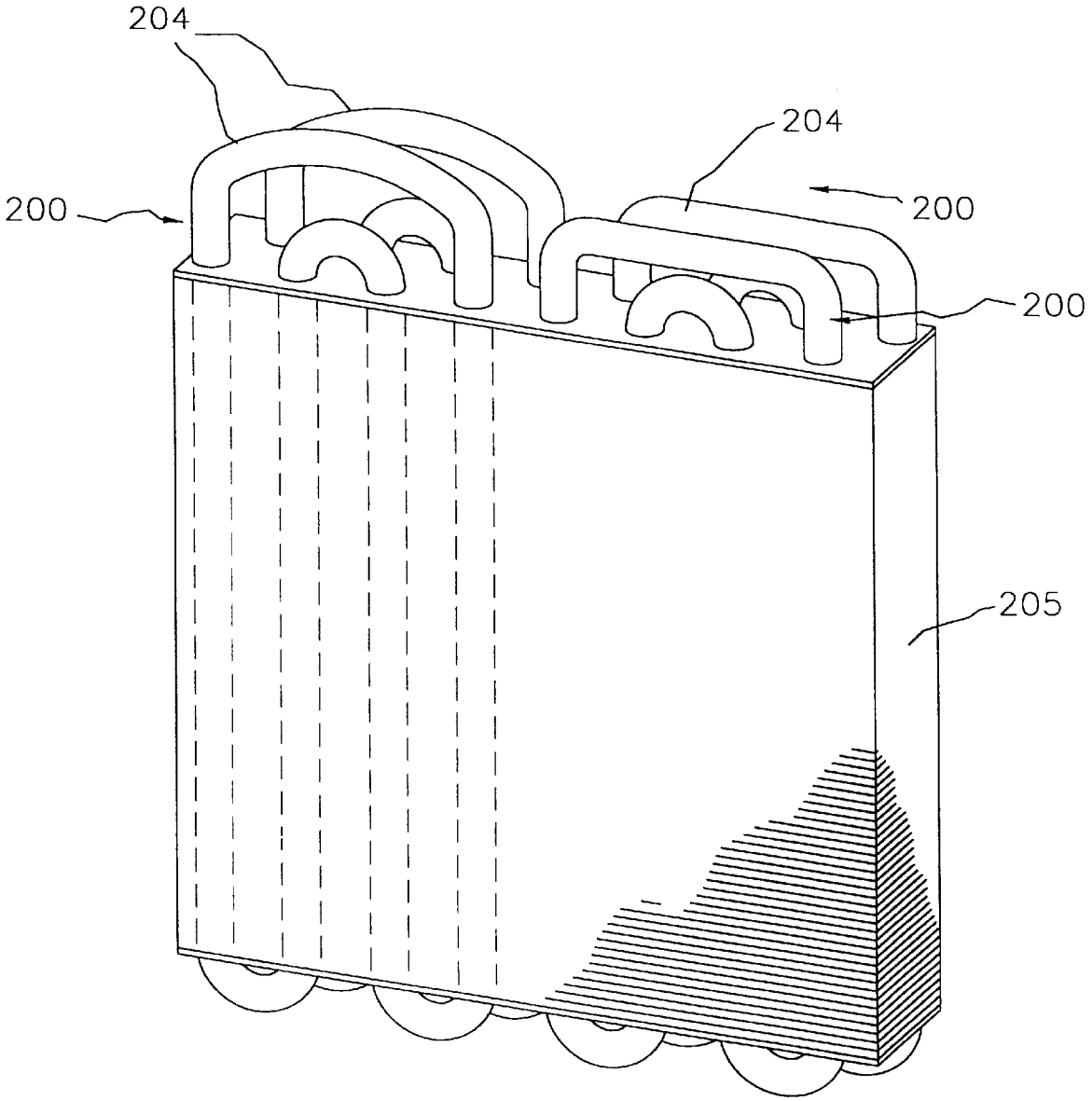
FIG. 17 illustrates a one-slab heat pipe heat exchanger having several rows of the continuous closed-loop pipe in accordance with the invention.

FIG. 14 illustrates a continuous closed-loop pipe 200 that serves as a heat pipe in a one-slab heat pipe heat exchanger 205. The continuous closed-loop pipe 200 includes a serpentine section 203 and a non-serpentine section 204. In this embodiment of the invention, the non-serpentine section is linear. However, as shown in FIG. 17 the non-serpentine section 204" may be curved.

The continuous closed-loop pipe 200 is divided into a first portion 201 and a second portion 202. The first portion 201 can serve either as the evaporator or the condenser. The second portion 202 will then serve as the other of the evaporator or the condenser. A central divider, dividing wall 207, can be installed in the one-slab heat pipe heat exchanger 205 in order to divide the continuous closed-loop pipe into the first and second portions 201, 202.

As shown in this preferred embodiment, the first portion 201 consists only of a first part of the serpentine section 203 of the continuous closed-loop 200. The second portion of the continuous closed-loop pipe 200 consists of a second part of the serpentine section 203 and the non-serpentine, linear, section 204. The non-serpentine section 204 connects operative ends of the serpentine section together.

Although this preferred embodiment illustrates the continuous closed-loop pipe with a serpentine section, it is to be understood that the pipe can have any configuration as long as it can be divided into two portions that can serve, respectively, as an evaporator and a condenser. For example, the continuous closed-loop pipe could be a single circular, oval, or square loop.

Figure 15:
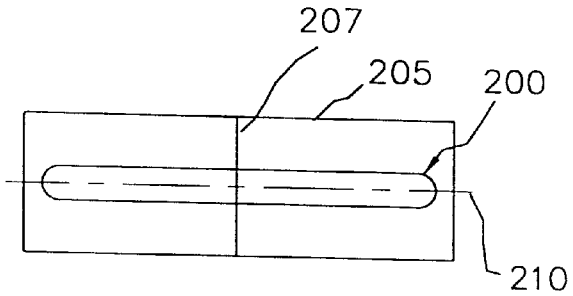
FIG. 15 illustrates a top sectional view of the one-slab serpentine heat pipe heat exchanger shown in FIG. 14.

As shown in FIG. 15, the continuous closed-loop pipe 200 is in a single plane 210. Thus, the one-slab heat pipe heat exchanger 205 comprises a single pipe 200 and a plurality of fins 206 in order to create the device.

Figure 16:
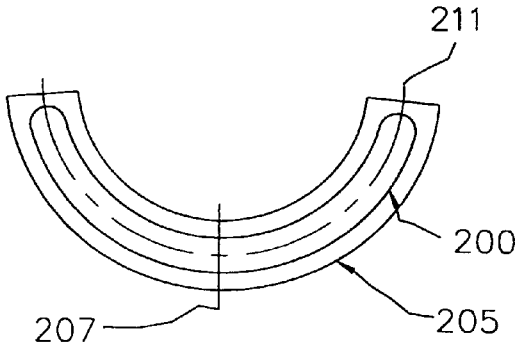
FIG. 16 shows an alternative configuration of the one-slab heat pipe heat exchanger shown in FIGS. 14 and 15.

FIG. 16 shows an alternate embodiment of the one-slab heat pipe heat exchanger shown in FIGS. 14 and 15. In FIG. 16, the one-slab heat pipe heat exchanger has been bent around the central divider, wall 207. Thus, the continuous closed-loop pipe lies on the U configuration 211.

Figure 16A:
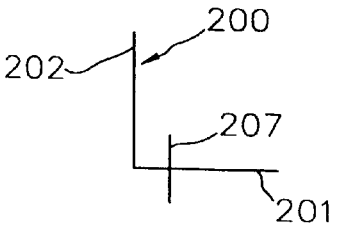
FIGS. 16A and 16B shows, schematically, further alternative configurations of the one-slab heat pipe heat exchanger shown in FIGS. 14 and 15.
Figure 16B:
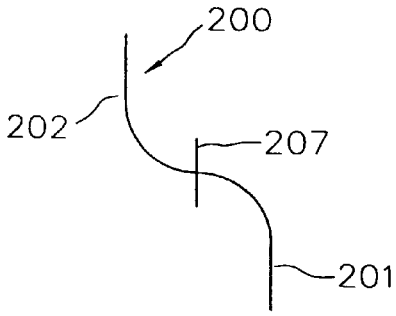

Although, FIG. 16 shows the one-slab heat pipe heat exchanger of FIGS. 14 and 15 bent into a U configuration, it is to be understood that the slab may be bent into any orientation about the central divider 207. For example, the one-slab heat pipe heat exchanger can be formed as an L or have portions 201 and 202 extending in different directions such that they form a curved line as shown, respectively, in FIGS. 16A and 16B.

FIG. 17 shows a one-slab heat pipe heat exchanger having several of the continuous closed-loop pipes similar to the pipe 200 shown in FIG. 14. In the one-slab heat pipe heat exchanger 205', the continuous closed-loop pipes 200' can have a non-serpentine section that is linear 204' or non-linear 204". The one-slab heat pipe heat exchanger 205' also includes a central divider, a dividing wall, and fins that assist in the heat transfer process.

Figure 18A:
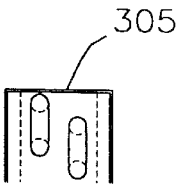
FIG. 18A shows a left hand view of the heat pipe heat exchanger shown in FIG. 18.
Figure 18:
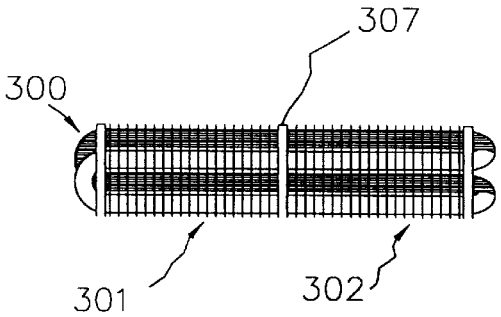
FIG. 18 illustrates yet another configuration of the one-slab heat pipe heat exchanger with a three dimensional continuous closed-loop pipe in accordance with the invention.

FIG. 18 shows a modified embodiment of the continuous closed-loop pipe shown in FIG. 14. The continuous closed-loop pipe 300 shown in FIG. 18 is three dimensional. In terms of this embodiment of the invention, the term three dimensional means that the all of the pipe itself does not lie along the same plane or line as shown in FIGS. 15 and 16.

The continuous closed-loop pipe 300 of FIG. 18 also includes a first portion 301 and a second portion 302. The first portion 301 and the second portion 302 act as either the evaporator or the condenser depending on the placement of the one-slab heat pipe heat exchanger 305 in different air flows. As with the one-slab heat pipe heat exchanger discussed above, the one-slab heat pipe heat exchanger of FIG. 18 includes a central divider, wall 307. The heat exchanger also includes fins 306 in order to assist in the heat transfer process.

Figure 18B:
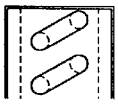
FIG. 18B shows a right hand view of the heat pipe heat exchanger shown in FIG. 18.
Figure 19:
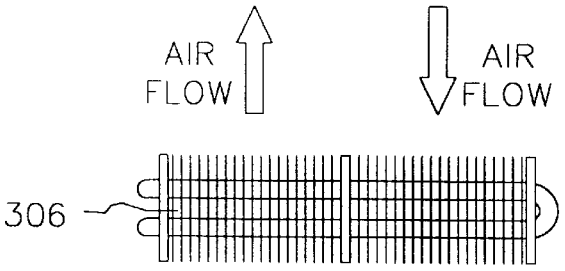
FIG. 19 shows a top view of the one-slab heat pipe heat exchanger shown in FIG. 18.

FIGS. 18A and 18B show end views of the three dimensional continuous closed-loop pipe 300 employed in FIG. 18. FIG. 19 is a top view of the device shown in FIG. 18.

Figure 20:
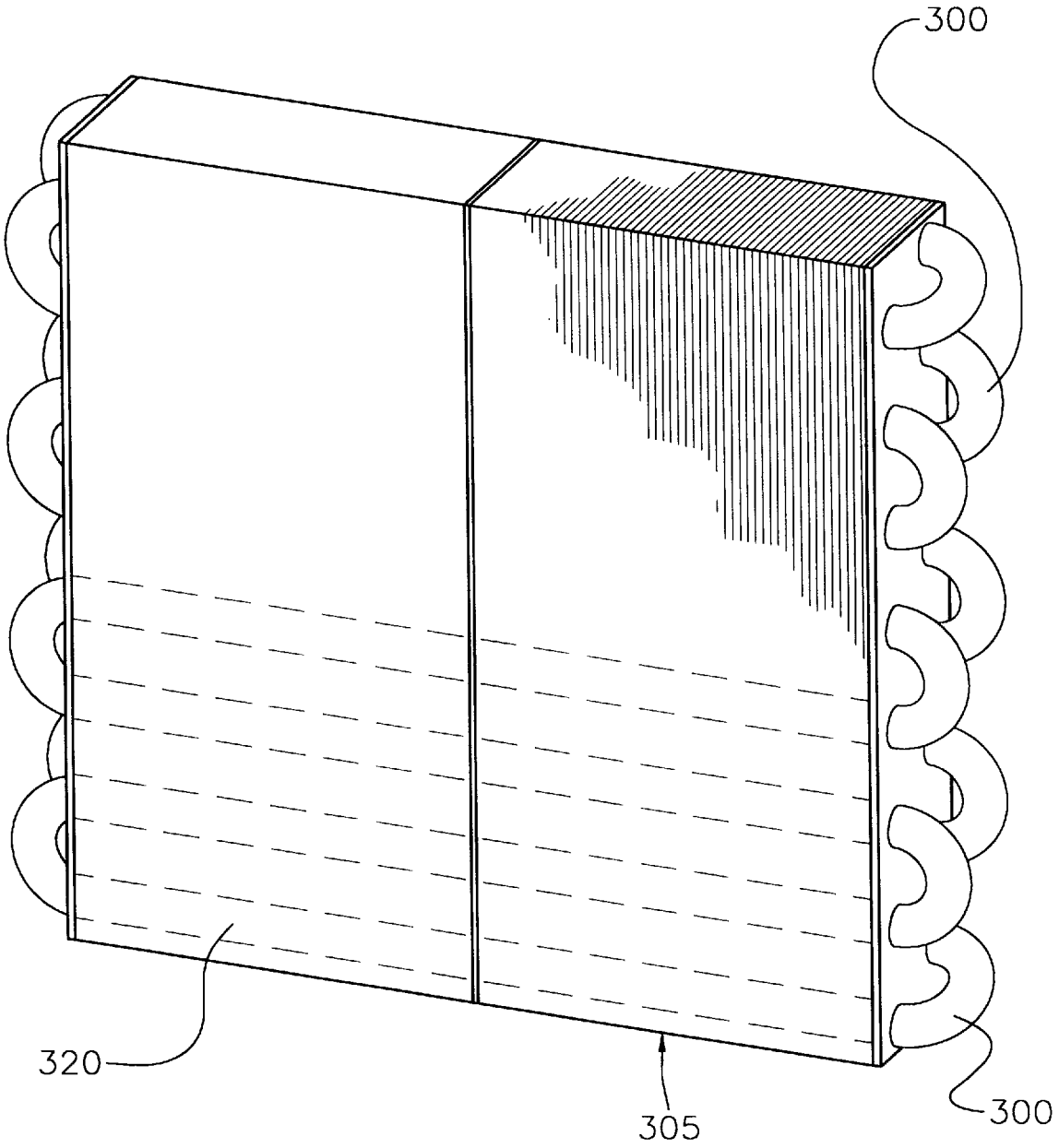
FIG. 20 is a perspective view of a one-slab heat pipe heat exchanger having several rows of the three dimensional continuous closed-loop pipe in accordance with the invention.

FIG. 20 is a one-slab heat pipe heat exchanger employing a plurality of three dimensional closed-loop pipes in a manner similar to a pipe 300 shown in FIG. 18. As with pipes 200, 200', and 300, the pipes 300' in FIG. 20 allow the refrigerant to flow through the pipe in a continuous manner. The refrigerant flows through each of the pipes because of the pressure within the pipes and temperature difference exposed to the pipes.

Figure 1:
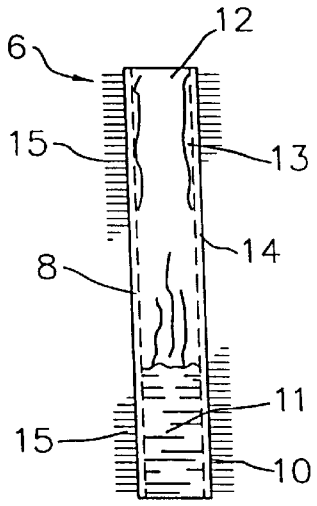
FIG. 1 PRIOR ART
FIG. 1 is a schematic sectional side view of a conventional heat pipe.
Figure 2:
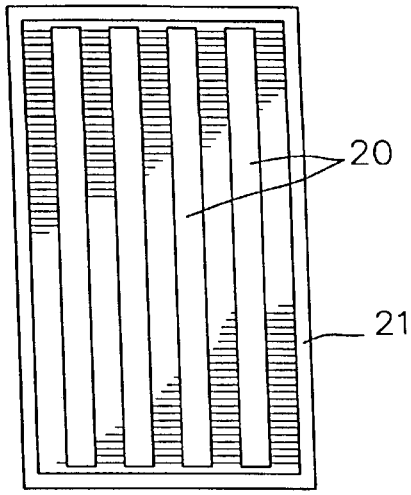
FIG. 2 PRIOR ART
FIG. 2 is a schematic sectional side view of a conventional heat pipe heat exchanger having multiple independent heat pipes.

Because each of the pipes 200, 200', 300, and 300' is a continuous closed-loop, a portion of the refrigerant traverses a complete path of the pipe during operation. The refrigerant actually flows through the pipes in a pumping or more specifically a percolating manner. While a portion of the refrigerant traverses the continuous closed-loop pipe during operation of the one-slab heat pipe heat exchanger, a separate portion of the refrigerant operates within each of the linear tubes, for example tubes 320 in FIG. 20, of the serpentine sections of the heat pipe in a manner similar to the standard conventional heat pipe shown in FIG. 1.

The continuous closed-loop heat pipe of the present invention can be installed in an air duct irrespective of gravitational concerns because the condenser portion of the heat pipe does not have to be higher than the evaporator. Thus, the continuous closed-loop heat pipe easily fits around the evaporator or into the ducting of an existing air conditioning system to provide enhanced dehumidification. In addition, it is to be understood that by employing the gravitational effects and the pumping action of the refrigerant created by the continuous closed-loop heat pipe, the present invention creates a more efficient heat pipe heat exchanger than the prior art systems.

Figure 23:
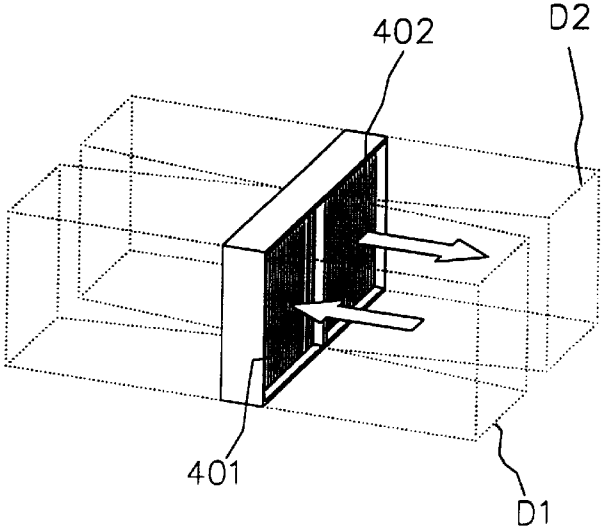
FIGS. 21–23 illustrate the one-slab heat pipe heat exchanger of FIGS. 14, 18, and 20 in different operative arrangements in air conditioning ducts.
Figure 22:
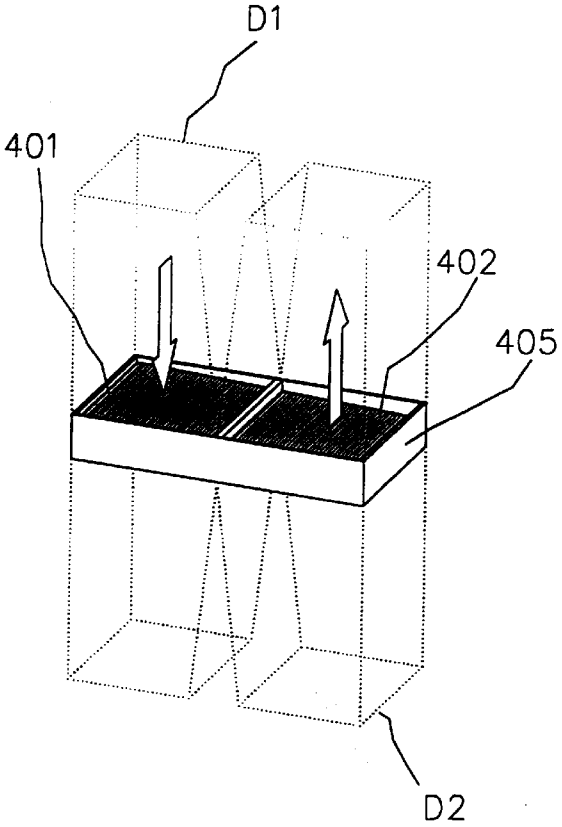
Figure 21:
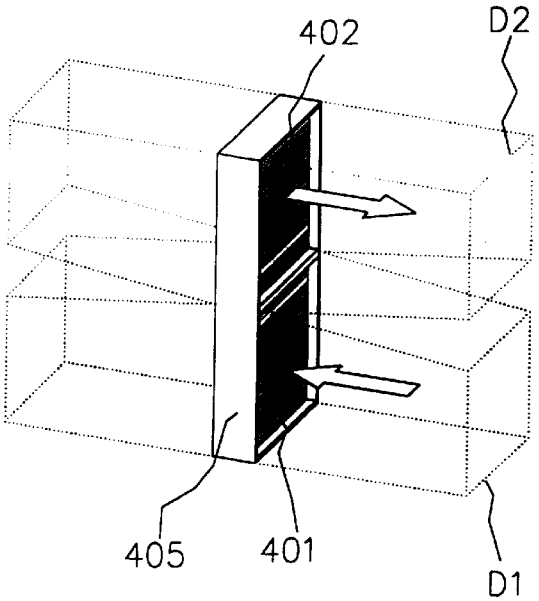

FIGS. 21–23 show a one-slab heat pipe heat exchanger 400 installed in different orientations in the intake duct D1 leading to and the outlet duct D2 leading from the evaporator of an air conditioning system. Because of the continuous closed-loop heat pipe, the actual placement of the one-slab heat pipe heat exchanger 405 in each of the ducts is not important for operation. This is because gravitational effects are not needed to operate the device. In each of the arrangements, the one-slab heat pump heat exchanger 405 employs either a continuous closed-loop pipe 200 shown, for example, in FIG. 14 or the three-dimensional continuous closed-loop pipe 300 shown, for example, in FIG. 18.

Each of the employed continuous closed-loop pipes includes a first portion 401 and a second portion 402. As shown in FIG. 21 the first portion 401 is in the intake duct D1 and thus operates as the evaporator of the one-slab heat pipe exchanger 405. FIG. 21 also shows that the second portion 402 of the continuous closed-loop pipe is installed in the outlet duct D2 and thus operates as a condenser for the heat exchanger 405.

FIG. 21 shows a top/bottom duct arrangement. FIG. 22 shows the heat pipe heat exchanger 405 installed in a vertical side-by-side duct arrangement.

FIG. 23 shows the heat exchanger 405 in a horizontal side-by-side heat exchanger. Because a continuous closed-loop pipe is employed in a heat exchanger 405 and a difference in level is not required for the heat pipe heat exchanger to operate, the heat exchanger can be placed in the horizontal side-by-side duct arrangement shown in FIG. 23. The continuous closed-loop pipe in the heat exchanger 405 is oriented is a similar manner to that of FIGS. 14 and 18.

Moreover, although not illustrated in the drawings, because of the use of the continuous closed-loop pipe, the heat pipe heat exchanger can be installed in a duct system that has both vertical and horizontal side-by-side ducts.

The continuous closed-loop heat pipe that is used in the one-slab heat pipe heat exchanger as discussed above with regards to FIGS. 14–23 accomplishes the method as discussed in the one of the objectives of this invention. The method employs using a continuous closed-loop pipe and a refrigerant. The refrigerant is pumped through the continuous closed-loop pipe by the pressure created in the pipe when the pipe is employed as a heat pipe. The refrigerant is actually forced through the pipe in a percolating manner. Because the refrigerant is forced through the pipe, the pipe can be smaller than the pipes used with conventional heat pipes. Thus, a heat pipe heat exchanger that employs the continuous closed-loop pipe can be easily manufactured and can be employed in an orientation irrespective of gravity. Thus, creating a more functional and readily installable heat pipe.

It is to be understood that various modifications, changes, and alterations in the form of the invention as described herein in its preferred embodiments may be made without departing from the spirit and scope of the invention, as defined in the appending claims and equivalence thereof.

What is claimed is:

1. A device, comprising:

a continuous valve-less closed-loop pipe, said continuous closed-loop pipe having at least first, second, third, and fourth generally longitudinal sections which are all spaced laterally from one another;

a wall that extends across each of said sections to divide each of said sections into a first portion and a substantially adjoining second portion of said continuous valve-less closed-loop pipe, wherein said first and second sections lie at least generally in a first plane and said third and fourth sections lie at least generally in a second plane which is spaced from said first plane; and a refrigerant contained within said continuous valve-less closed-loop pipe, said refrigerant being capable of flowing 1) from said first section and into said second sections and 2) from said third and second and into said fourth section, wherein said first portion of each of said sections serves as an evaporator and said second portion of said sections serves as a condenser so that said continuous valve-less closed-loop pipe forms a heat pipe, and wherein said continuous valve-less closed-loop heat pipe, said wall, and said refrigerant are configured and arranged relative to one another such that, in operation, generally regardless of the orientation of said continuous valve-less closed-loop heat pipe relative to a horizontal plane, 1) a first portion of the refrigerant continuously flows though the entire continuous valve-less closed-loop pipe in a loop and 2) a second portion of the refrigerant continuously and bi-directionally flows within each of said sections between said evaporator and said condenser, the first portion of the refrigerant thereby transferring heat from the evaporator to the condenser and the second portion of the refrigerant thereby transferring heat within each of said sections.

2. The device of claim 1, further comprising at least one additional continuous closed-loop pipe with refrigerant to form a one-slab multiple row heat pipe heat exchanger.

3. A device of claim 1, wherein said first and second sections are connected by a curved section and said third and fourth sections are connected by a curved section.

4. A device as claimed in claim 1, wherein said wall has at least one flat surface.

5. A device as claimed in claim 4, wherein said at least one flat surface is substantially perpendicular to said at least two first generally longitudinal sections.

6. A method comprising:

providing a continuous valve-less closed-loop pipe having at least 1) first, second, third, and fourth generally longitudinal sections which are all spaced laterally from one another, and 2) a wall that extends across each of said sections to divide each of said sections into a first portion and a substantially adjoining second portion, wherein said first and second sections lie at least generally in a first plane and said third and fourth sections lie at least generally in a second plane which is spaced from said first plane;

inserting sufficient refrigerant within said continuous closed-loop pipe so that said first portion of each of said sections serves as an evaporator and said second portion of each of said sections serves as a condenser so that said continuous valve-less closed-loop pipe forms a heat pipe;

permitting first and second fluid bodies to flow over said first and second portions of said longitudinal sections;

absorbing heat from said first fluid body and dissipating heat into said second fluid body, wherein substantially the entire surface area of said continuous valve-less closed-loop pipe either absorbs or dissipates heat;

exchanging heat between said evaporator and said condenser, including the steps of 1) causing a first portion of the refrigerant to continuously flow through the entire continuous valve-less closed-loop pipe in a loop and 2) causing a second portion of the refrigerant to continuously and bi-directionally flow within each of the longitudinal sections between said evaporator and said condenser, wherein the heat exchanging step does not rely exclusively on gravitational forces and takes place generally regardless of the orientation of said continuous valve-less closed-loop heat pipe relative to a horizontal plane, wherein refrigerant flows 1) from said first section and into said second and 2) from said third section and into said fourth section.

7. The method of claim 6, further comprising:

installing said continuous closed-loop pipe in an air path so that a pumping action of the refrigerant is developed in said continuous closed-loop pipe.

8. The method of claim 6, further comprising:

selecting said continuous closed-loop pipe so when said continuous closed-loop pipe is placed in an air flow a pumping action of the refrigerant is developed.

9. The method as claimed in claim 6 wherein the step of providing comprises the step of providing the wall with at least one flat surface.

10. The method as claimed in claim 9, wherein the step of providing further comprises the step of arranging said at least one flat surface substantially perpendicular to said at least two first generally longitudinal sections.

11. A device, comprising:

a continuous valve-less closed-loop pipe, said continuous closed-loop pipe having at least first, second, third, and fourth generally longitudinal sections which are all spaced laterally from one another, said first and second sections lying at least generally in a first plane and said third and fourth sections lying at least generally in a second plane which is spaced from said first plane;

a wall that extends across each of said sections to divide each of said sections into a first portion and a substantially adjoining second portion of said continuous valve-less closed-loop pipe; and a refrigerant contained within said continuous valve-less closed-loop pipe, wherein said first portion of each of said sections serves as an evaporator and said second portion of each of said sections serves as a condenser so that said continuous valve-less closed-loop pipe forms a heat pipe, and wherein said continuous valve-less closed-loop heat pipe, said wall, and said refrigerant are confused and arranged relative to one another such that, in operation, generally regardless of the orientation of the continuous valve-less closed-loop heat pipe relative to a horizontal plane, 1) substantially the entire surface area of said continuous valve-less closed-loop pipe is not covered by said wall and can either absorb or dissipate heat, 2) a first portion of the refrigerant continuously flows through the entire continuous valve-less closed-loop pipe in a loop, and 3) a second portion of the refrigerant continuously and bi-directionally flows within each of said sections between said evaporator and said condenser, said fist portion of the refrigerant thereby transferring heat from said evaporator to said condenser and said second portion of said refrigerant thereby transferring heat within each of said sections.

12. A method comprising:

providing a continuous valve-less closed-loop heat pipe having at least first, second, third, and fourth generally parallel, spaced tubular sections, wherein said first and second sections lie at least generally in a first plane a said third and fourth sections lie at least generally in a second plane which is spaced from said first plane, wherein said heat pipe is charged with a refrigerant, and wherein a wall extends across said first, second, third, and fourth sections to define an evaporator on one side of said wall and a condenser on another side of said wall;

directing a stream of hot fluid and a stream of cold fluid to flow over said evaporator and said condenser in opposite directions such that 1) said stream of hot fluid flows through said first and second planes in sequence and 2) said stream of cold fluid flows through said second and first planes in sequence; and absorbing heat into said evaporator from said stream of hot fluid and dissipating heat into said stream of cold fluid from said condenser, wherein said stream of bot fluid is cooled initially as it passes through said first plane and is cooled additionally as it passes though said second plane, wherein said stream of cold fluid is heated initially as it passes through said second plane and is heated additionally as it passes through said first plane, wherein refrigerant vaporizes in said evaporator and condenses in said condenser such that 1) a first portion of the refrigerant continuously flows through the entire heat pipe in a loop, and 2) a second portion of the refrigerant continuously and bi-directionally flows within each of the longitudinal sections between said evaporator and said condenser, and wherein refrigerant flow through said heat pipe does not rely exclusively on gravitational forces and takes place generally regardless of the orientation of said heat pipe relative to a horizontal plane.

* * * * *